US012419471B2

(12) United States Patent
Liu

(10) Patent No.: US 12,419,471 B2
(45) Date of Patent: Sep. 23, 2025

(54) TOILET COVER PLATE AND TOILET

(71) Applicant: Shanghai Kohler Electronics, Ltd., Shanghai (CN)

(72) Inventor: Xiumin Liu, Shanghai (CN)

(73) Assignee: Shanghai Kohler Electronics, Ltd., Shanghai (CN)

( * ) Notice: Subject to any disclaimer, the term of this patent is extended or adjusted under 35 U.S.C. 154(b) by 375 days.

(21) Appl. No.: 18/073,167

(22) Filed: Dec. 1, 2022

(65) Prior Publication Data

US 2023/0180975 A1 Jun. 15, 2023

(30) Foreign Application Priority Data

Dec. 9, 2021 (CN) ..... 202123086098.1

(51) Int. Cl.
*A47K 13/24* (2006.01)

(52) U.S. Cl.
CPC ..... *A47K 13/24* (2013.01)

(58) Field of Classification Search
None
See application file for complete search history.

(56) References Cited

U.S. PATENT DOCUMENTS 3,601,822 A * 8/1971 Weiss ..... A47K 13/06 D23/311
3,837,011 A * 9/1974 McTighe ..... E03D 9/002 4/662
5,715,544 A * 2/1998 Huffman ..... E03D 11/13 4/420
5,920,918 A * 7/1999 Thomas ..... E03D 1/01 D23/313
2014/0059750 A1* 3/2014 Bochnik ..... A47K 13/307 4/209 R
2020/0199860 A1* 6/2020 Giertz ..... E03D 9/08
2020/0393475 A1* 12/2020 Hall ..... A47K 13/24
2021/0015314 A1* 1/2021 Sylvia ..... E03D 9/08

FOREIGN PATENT DOCUMENTS

CN 210043913 U * 2/2020

OTHER PUBLICATIONS

Extended European Search Report from European Patent Application No. 22211928.1, dated Apr. 14, 2023, 9 pages.

* cited by examiner

*Primary Examiner* — Christine J Skubinna
(74) *Attorney, Agent, or Firm* — Lempia Summerfield Katz LLC

(57) ABSTRACT

A toilet cover plate includes a cover plate body, including a channel and a body recess disposed on a top surface of the cover plate body and connected with the channel. The toilet cover plate also includes a flip cover disposed on the cover plate body and pivotally mounted in the body recess. When the flip cover is in an initial state, the flip cover is received in the body recess and covers an opening of the channel. The toilet cover plate also includes a holding mechanism disposed between the flip cover and the cover plate body and configured to keep the flip cover received in the body recess.

20 Claims, 5 Drawing Sheets

TOILET COVER PLATE AND TOILET

CROSS REFERENCE TO RELATED APPLICATION

This application claims the benefit of priority to: Chinese Patent Application No. 202123086098.1 filed in the Chinese Intellectual Property Office on Dec. 9, 2021, which is hereby incorporated by reference in its entirety.

FIELD

The present disclosure relates to the field of sanitary product technologies, and particularly to a toilet cover plate and a toilet.

BACKGROUND

A smart toilet has electrical apparatus elements mounted in a rear body of a toilet plate cover. In order to avoid water from flowing into the rear body, the rear body is rarely provided with an opening at a top portion. Even if the rear body is provided with the opening at the top portion, the cover plate is usually fixed on the rear body by screws to meet waterproof requirements. When a user wants to put in consumable accessories through this opening, the screws need to be released through tools to remove the cover plate. After the mounting or placing of the consumable accessories is completed, the cover plate is covered again, and the screws are tightened, so that the operation is cumbersome.

In view of the above technical problem, it is necessary to provide a toilet cover plate and a toilet with a good waterproof effect and convenient replacement of accessories.

SUMMARY

The present disclosure aims to overcome the defects in the prior art, and provide a toilet cover plate and a toilet with a good waterproof effect and convenient replacement of accessories.

The present disclosure provides a toilet cover plate, which comprises a cover plate body and a flip cover arranged on the cover plate body.

A channel is arranged in the cover plate body, and a top surface of the cover plate body is provided with a body recess communicated with the channel.

The flip cover is pivotally mounted in the body recess, and when the flip cover is in an initial state, the flip cover is closed in the body recess and covers an opening of the channel.

A bottom surface of the flip cover is provided with a sealing member for sealing the opening of the channel.

A holding mechanism for keeping the flip cover closed in the body recess is arranged between the flip cover and the cover plate body.

In an embodiment, the holding mechanism comprises an elastic member connected between the flip cover and the cover plate body, and the elastic member is located in the body recess.

In an embodiment, the flip cover is connected with the cover plate body through a pivotal shaft, and the pivotal shaft is located in the body recess. The elastic member is a torsion spring sleeved on the pivotal shaft.

In an embodiment, the holding mechanism comprises a magnetic attraction assembly for tightly attracting the flip cover in the body recess. The magnetic attraction assembly comprises a first element and a second element, which are capable of magnetically attracting each other. The first element is mounted in the body recess. The second element is mounted on the bottom surface of the flip cover.

In an embodiment, the first element is a magnet, and the second element is an iron sheet. Alternatively, the first element is an iron sheet, and the second element is a magnet.

In an embodiment, more than two second elements are mounted on the bottom surface of the flip cover at intervals, and correspondingly, more than two first elements are mounted in the body recess at intervals.

In an embodiment, the sealing member is a sealing gasket or a sealing ring.

In an embodiment, the sealing gasket or the sealing ring is a foam sealing gasket or a foam sealing ring.

In an embodiment, one side of the flip cover is provided with a hand clasping groove, and a wall of the body recess is provided with a wall recess corresponding to the hand clasping groove.

The present disclosure further provides a toilet, which comprises the toilet cover plate according to any one of the items above.

By adopting the technical solutions above, the present disclosure has the following beneficial effects:

according to the toilet cover plate and the toilet provided by the present disclosure, the flip cover of the toilet cover plate is capable of being opened by flipping, which is convenient for a user to replace accessories. When the flip cover is closed, under an action of the holding mechanism, the flip cover is kept in the body recess, and the opening of the channel is sealed by the sealing member. Thus, a waterproof effect may be achieved.

BRIEF DESCRIPTION OF THE FIGURES

With reference to the drawings, the contents disclosed by the present disclosure should be more easily understood. It should be understood that these drawings are merely used for illustration and are not intended to limit the protection scope of the present disclosure. In the drawings.

DETAILED DESCRIPTION

Figure 1:
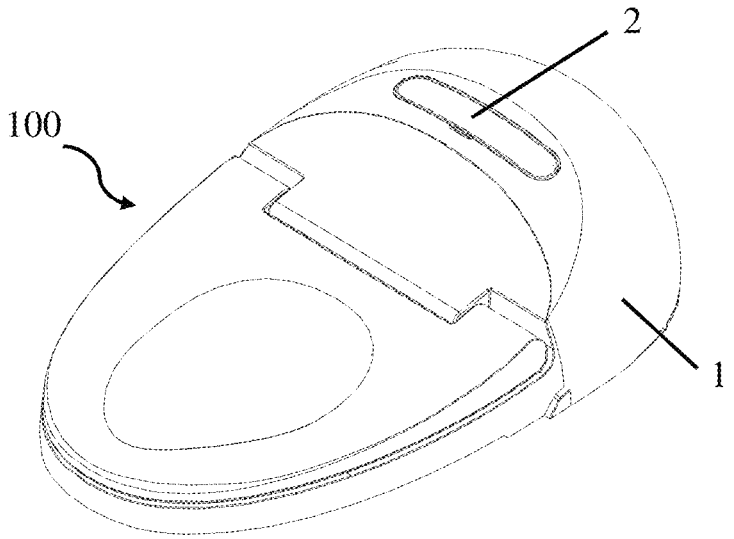
FIG. 1 is a schematic diagram of a toilet cover plate provided by an example of the present disclosure with a flip cover in an initial state.

The specific embodiments of the present disclosure are further described with reference to the drawings hereinafter. Same or equivalent parts are denoted by same reference numerals. It should be noted that the terms “front”, “back”, “left”, “right”, “up” and “down” used in the following description refer to the directions in the drawings, and the terms “inner” and “outer” refer to the directions towards or far away from geometric centers of specific parts respectively.

Figure 2:
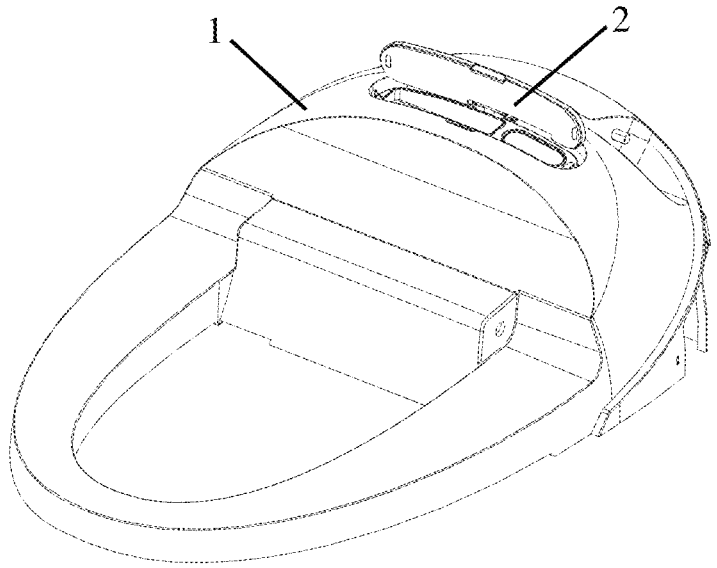
FIG. 2 is a schematic diagram of the toilet cover plate provided by an example of the present disclosure with the flip cover in an opened state.
Figure 3:
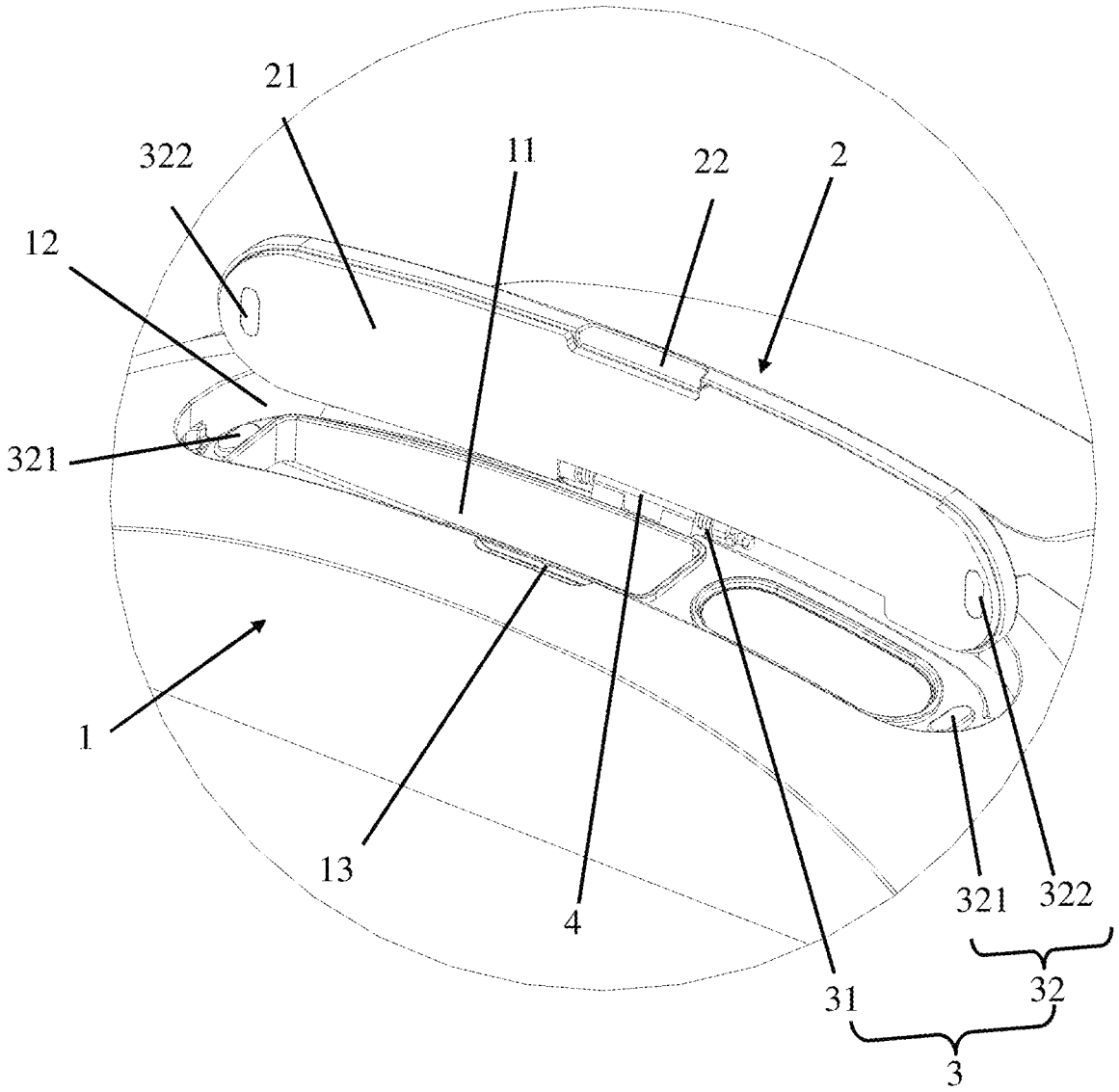
FIG. 3 is an enlarged view of the flip cover in the opened state.
Figure 4:
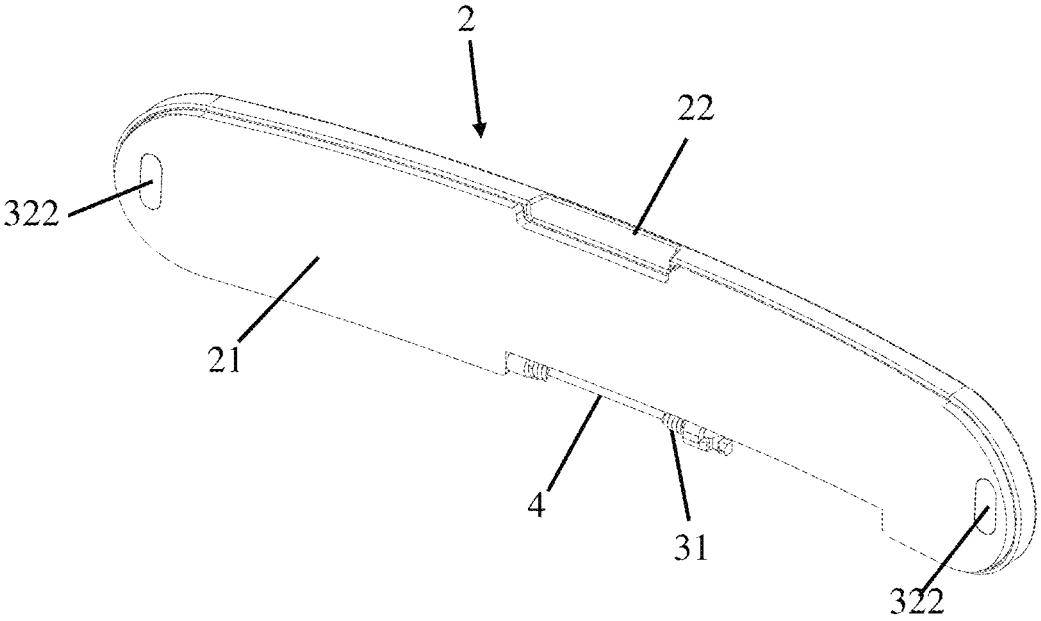
FIG. 4 is a perspective view of the flip cover.
Figure 5:
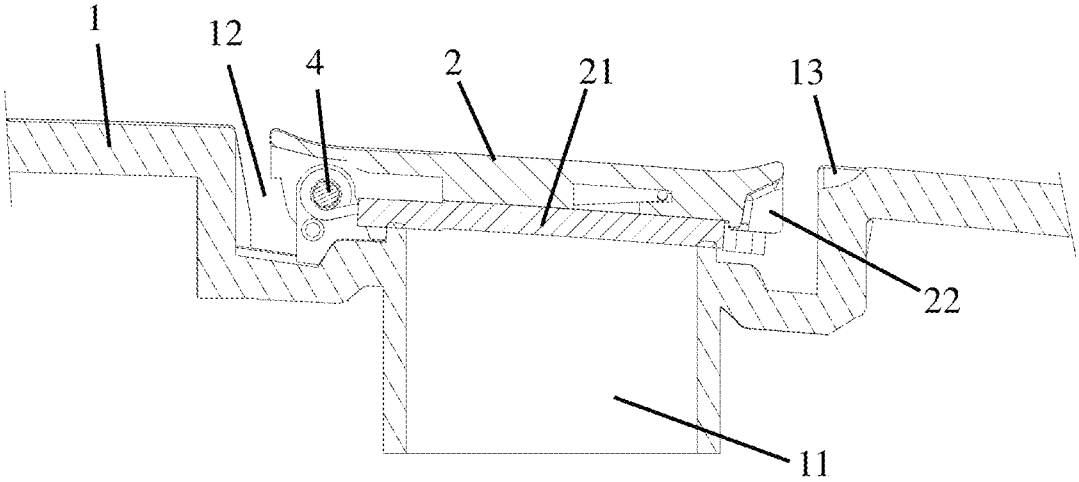
FIG. 5 is a sectional view of the flip cover in the initial state.

FIG. 1 is a schematic diagram of a toilet cover plate provided by an example of the present disclosure with a flip cover in an initial state. FIG. 2 is a schematic diagram of the toilet cover plate provided by an example of the present disclosure with the flip cover in an opened state. FIG. 3 is an enlarged view of the flip cover in the opened state. FIG. 4 is a perspective view of the flip cover. FIG. 5 is a sectional view of the flip cover in the initial state.

As shown in FIG. 1-FIG. 5, an embodiment of the present disclosure provides a toilet cover plate 100, which comprises a cover plate body 1 and a flip cover 2 arranged on the cover plate body 1.

A channel 11 is arranged in the cover plate body 1, and a top surface of the cover plate body 1 is provided with a body recess 12 communicated or connected with the channel 11.

The flip cover 2 is pivotally mounted in the body recess 12. When the flip cover 2 is in an initial state, the flip cover 2 is closed or received in the body recess 12 and covers an opening of the channel 11.

A bottom surface of the flip cover 2 is provided with a sealing member 21 configured to seal the opening of the channel 11.

A holding mechanism 3 configured to keep the flip cover 2 closed in the body recess 12 is arranged between the flip cover 2 and the cover plate body 1.

The toilet cover plate 100 provided by the present disclosure comprises the cover plate body 1, the flip cover 2, and the holding mechanism 3. The cover plate body 1 is disposed at a rear end of the toilet cover plate 100, and the channel 11 is arranged in the cover plate body 1. The channel 11 is used for a user to replace consumable accessories.

In an embodiment, the consumable accessories may include detergents sprayed from the toilet cover plate 100 to clean a toilet bowl 210 of the toilet or clean the body of a user. The detergents may be housed in a container of the toilet cover plate 100. In this embodiment, the channel 11 may allow a user to add new detergents to the container. In other words, the new detergents may flow into the container through the channel 11.

In another embodiment, the consumable accessories may include disposable toilet seat covers (e.g., plastic films) automatically dispensed from the toilet cover plate 100. The clean and used toilet seat covers may be housed in a container of the toilet cover plate 100. In this embodiment, the channel 11 may allow a user's hand to reach the container so as to add clean toilet seat covers or remove the used seat covers.

However, the detergents and the toilet seat covers are provided herein as non-limiting examples of the consumable accessories that may be configured to utilize aspects of the present disclosure. For example, in order to extend the life of the toilet cover plate 100, the consumable accessories include a filter configured to remove impurities from the water before the water is used by the toilet cover plate 100. Thus, the filter needs to be regularly, e.g., every 6 months, replaced with a new filter.

For another example, the consumable accessories include a fan configured to provide wind for the user and/or a heater configured to heat the toilet seat. Because these accessories may be subject to aging over the time, the fan and/or the heater may also need to be replaced.

Thus, the consumable accessories in the present disclosure may include any types of accessories used by the toilet cover plate 100.

A top portion of the cover plate body 1 is provided with the body recess 12, and the opening at a top portion of the channel 11 is located in a bottom plate of the body recess 12.

The flip cover 2 is mounted in the body recess 12 through a hinge or a rotating shaft. The flip cover 2 may be flipped by the user to be closed in the body recess 12 or flipped to be opened from the body recess 12. When the flip cover 2 is in the initial state, the flip cover 2 is closed in the body recess 12 and covers the opening of the channel 11. The bottom surface of the flip cover 2 is provided with the sealing member 21 for sealing the opening of the channel 11, so as to achieve a waterproof effect. The sealing member 21 may be a rubber sealing member. The flip cover 2 is a plastic member, and the sealing member 21 may be adhered to the flip cover 2 through glue.

The holding mechanism 3 is arranged between the flip cover 2 and the cover plate body 1 for keeping the flip cover 2 closed in the body recess 12, so that the flip cover 2 can be kept in the initial state. A spring, an elastic sheet, a torsion spring, a magnet, an air cylinder, or other mechanisms may be selected as the holding mechanism 3.

When the user needs to replace the accessories, the user may open the flip cover 2 by flipping the flip cover 2 to expose the opening of the channel 11, and then may replace the accessories. After completing the replacement of the accessories, the user may close the flip cover 2. Thus, the flip cover 2 may be kept in the body recess 12 through the holding mechanism 3, and the sealing member 21 may seal the opening of the channel 11, so as to achieve the waterproof effect.

According to the toilet cover plate provided by the present disclosure, the user may open the flip cover 2 of the toilet cover plate flipping the flip cover 2. Thus, it is convenient for the user to replace the accessories. When the flip cover 2 is closed, under an action of the holding mechanism 3, the flip cover 2 is kept in the body recess 12, and the opening of the channel 11 is sealed by the sealing member 21, so as to achieve the waterproof effect.

In one embodiment, as shown in FIG. 3 and FIG. 4, the holding mechanism 3 comprises an elastic member 31 connected between the flip cover 2 and the cover plate body 1, and the elastic member 31 is located in the body recess 12.

In the embodiment, the elastic member 31 is selected as the holding mechanism 3, such as a spring, an elastic sheet, a torsion spring and the like, and the flip cover 2 is driven to reset or rotate towards the body recess 12 by an elastic force of the elastic member 31. After the flip cover 2 is released, the flip cover 2 may automatically reset into or return to the body recess 12 under an action of the elastic member 31.

In one embodiment, as shown in FIG. 3 and FIG. 4, the flip cover 2 is connected with the cover plate body 1 through a pivotal shaft 4, and the pivotal shaft 4 is located in the body recess 12. The elastic member 31 is a torsion spring sleeved on the pivotal shaft 4.

In the embodiment, the flip cover 2 is connected with the cover plate body 1 through the pivotal shaft 4, and the flip cover 2 may rotate around the pivotal shaft 4 so to be opened and closed by flipping the flip cover 2. The elastic member 31 is the torsion spring, the torsion spring is sleeved on the pivotal shaft 4, and one end of the torsion spring abuts against the cover plate body 1 and the other end of the torsion spring abuts against the flip cover 2.

In one embodiment, as shown in FIG. 3, the holding mechanism 3 comprises a magnetic attraction assembly 32 configured to tightly attract the flip cover 2 in the body recess 12.

The magnetic attraction assembly 32 comprises a first element 321 and a second element 322, which are configured to be magnetically attracted to each other, the first element

321 is mounted in the body recess 12, and the second element 322 is mounted on the bottom surface of the flip cover 2.

In the embodiment, the magnetic attraction assembly 32 is selected as the holding mechanism 3 configured to tightly attract the flip cover 2 in the body recess 12. The magnetic attraction assembly 32 may be used in combination with the elastic member 31.

The magnetic attraction assembly 32 comprises the first element 321 and the second element 322, and the first element 321 and the second element 322 are configured to be magnetically attracted or configured to be attracted to each other. The first element 321 is mounted in the body recess 12, and the second element 322 is mounted on the bottom surface of the flip cover 2. When the flip cover 2 is closed, the first element 321 and the second element 322 are attracted to each other, so that the flip cover 2 can be tightly attracted in the body recess 12, and the sealing member 21 can seal the opening of the channel 11.

In one embodiment, the first element 321 is a magnet, and the second element 322 is an iron sheet. Alternatively, the first element 321 is an iron sheet, and the second element 322 is a magnet.

In one embodiment, the first element 321 is a first magnet, and the second element 322 is a second magnet. The first magnet and the second magnet may be attracted to each other.

In one embodiment, as shown in FIG. 3, more than two second elements 322 are mounted on the bottom surface of the flip cover 2 at intervals, and correspondingly, more than two first elements 321 are mounted in the body recess 12 at intervals, so that an attraction force to the flip cover 2 can be increased.

In one embodiment, the sealing member 21 is a sealing gasket or a sealing ring, and a rubber sealing gasket or a rubber sealing ring may be selected.

In one embodiment, the sealing gasket or the sealing ring is a foam sealing gasket or a foam sealing ring, which has a good waterproof effect and is soft and thus does not cause abrasion to the plastic member.

In one embodiment, as shown in FIGS. 3-5, one side of the flip cover 2 is provided with a hand clasping groove 22, and a wall of the body recess 12 is provided with a wall recess 13 corresponding to the hand clasping groove 22. Thus, it is convenient for fingers of the user or tools to insert, so as to open the flip cover 2 by flipping the flip cover 2.

Figure 6:
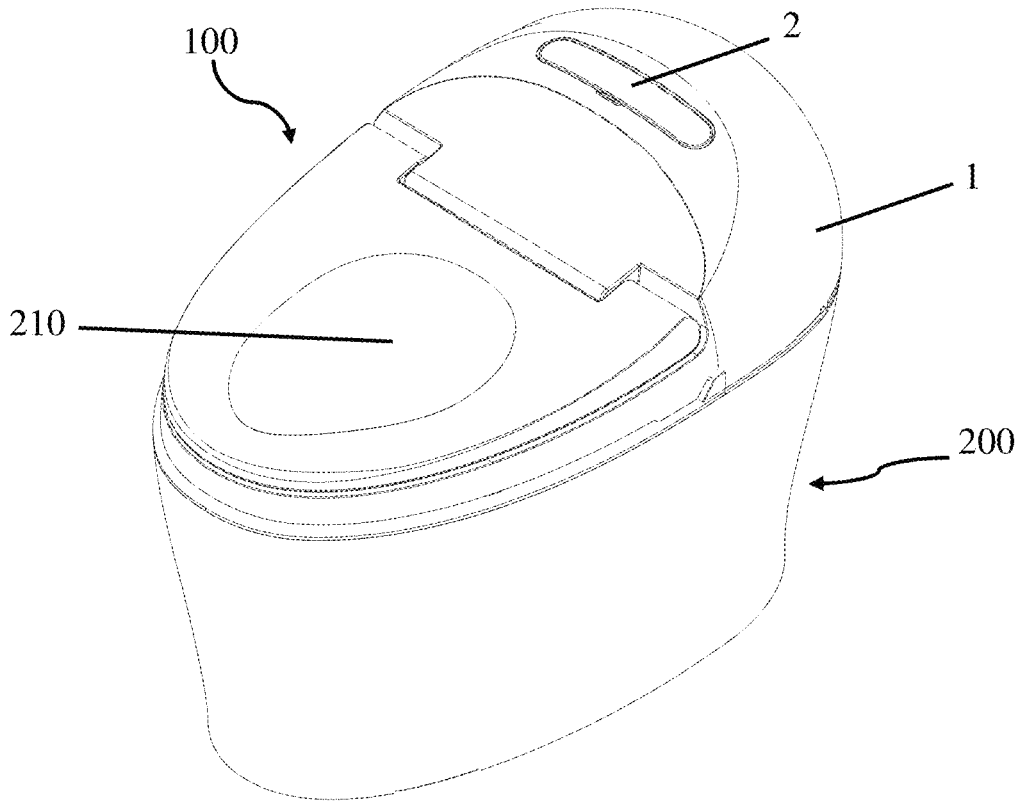
FIG. 6 is a perspective view of a toilet provided by an example of the present disclosure.

As shown in FIG. 6, an embodiment of the present disclosure provides a toilet, which comprises the toilet cover plate 100 according to any one of the embodiments above. The toilet cover plate 100 is mounted on a toilet body 200. The toilet body 200 may comprises a toilet bowl 210.

In an embodiment, the toilet includes a base (e.g., a pedestal, bowl, etc.) and a tank. The base is configured to be attached to another object such as a drainpipe, floor, or another suitable object. The base includes a bowl, a sump (e.g., a receptacle) disposed below the bowl, and a trapway fluidly connecting the bowl to a drainpipe or sewage line. The tank may be supported by the base, such as an upper surface of a rim. The tank may be integrally formed with the base as a single unitary body. In other embodiments, the tank may be formed separately from the base and coupled (e.g., attached, secured, fastened, connected, etc.) to the base. The toilet may further include a tank lid covering an opening and inner cavity in the tank. The toilet may include a seat assembly including a seat and a seat cover rotatably coupled to the base. The toilet may further include a hinge assembly.

In another embodiment, the toilet may be a tankless toilet. The toilet includes a base and a seat assembly coupled to the base. The base includes a bowl, a sump disposed below the bowl, and a trapway fluidly connecting the bowl to a drainpipe or sewage line. The toilet includes a waterline that supplies the toilet with water. The toilet may further include a seat assembly including a seat and a seat cover rotatably coupled to the base. The toilets described above are provided herein as non-limiting examples of toilets that may be configured to utilize aspects of the present disclosure.

In an embodiment, the toilet cover plate 100 may be a bidet. In some examples, the bidet may be included in a seat or pedestal of a toilet. In other examples, the bidet may be manufactured separately from and attached or coupled to a seat or pedestal of a toilet. The bidet includes a housing. The housing is configured to receive a flow of water through a housing inlet and dispense the flow of water from a housing outlet. The housing inlet and housing outlet may be located on opposite ends of the housing from one another, such that water may flow through the housing from the housing inlet to the housing outlet. In some examples, the housing further includes a chamber. As the housing receives the flow of water, the chamber may fill with water and provide a flow of water between the housing inlet and the housing outlet. The chamber may be configured to contain the flow of water and direct the flow of water from the housing inlet to the housing outlet. After the chamber has filled with water, the flow of water may travel along a substantially linear path between the housing inlet and the housing outlet. In some examples, one or more walls within the housing may be included to help direct a flow of water between the housing inlet and the housing outlet. The bidet may further include a housing inlet conduit configured to direct a flow of water to the housing inlet. The housing inlet conduit may be coupled to a water supply such as tank or waterline. The housing may further include a gear assembly or a portion of the gear assembly.

As noted above, the toilet cover plate 100 may comprise a cover plate body 1 and a flip cover 2 arranged on the cover plate body 1. A channel 11 is arranged in the cover plate body 1, and a top surface of the cover plate body 1 is provided with a body recess 12 communicated with the channel 11. The flip cover 2 is pivotally mounted in the body recess 12. When the flip cover 2 is in an initial state, the flip cover 2 is closed or received in the body recess 12 and covers an opening of the channel 11. A bottom surface of the flip cover 2 is provided with a sealing member 21 configured to seal the opening of the channel 11. A holding mechanism 3 configured to keep the flip cover 2 closed in the body recess 12 is arranged between the flip cover 2 and the cover plate body 1.

In an embodiment, the toilet cover plate 100 of the toilet may spray the water or the detergent to clean the toilet bowl 210 of the toilet or clean the body of the user. In this embodiment, the toilet cover plate 100 may comprises a container configured to house the detergent. The channel 11 may allow a user to add new detergents to the container. In other words, the new detergents may flow into the container through the channel 11.

In another embodiment, the toilet cover plate 100 of the toilet may automatically dispense the disposable toilet seat covers in response to a trigger condition, e.g., a detection of a human body or a detection of a button pressed by a user. In this embodiment, the toilet cover plate 100 may comprises a container configured to house the clean toilet seat covers and the used toilet seat covers. The channel 11 may allow a user's hand to reach the container so as to add clean toilet seat covers or remove the used seat covers.

According to the toilet cover plate and the toilet provided by the present disclosure, the flip cover 2 of the toilet cover plate may be opened by flipping and thus it is convenient for the user to replace the accessories. When the flip cover 2 is closed, under an action of the holding mechanism 3, the flip cover 2 is kept in the body recess 12, and the opening of the channel 11 is sealed by the sealing member 21, so as to achieve the waterproof effect.

Figure 7:
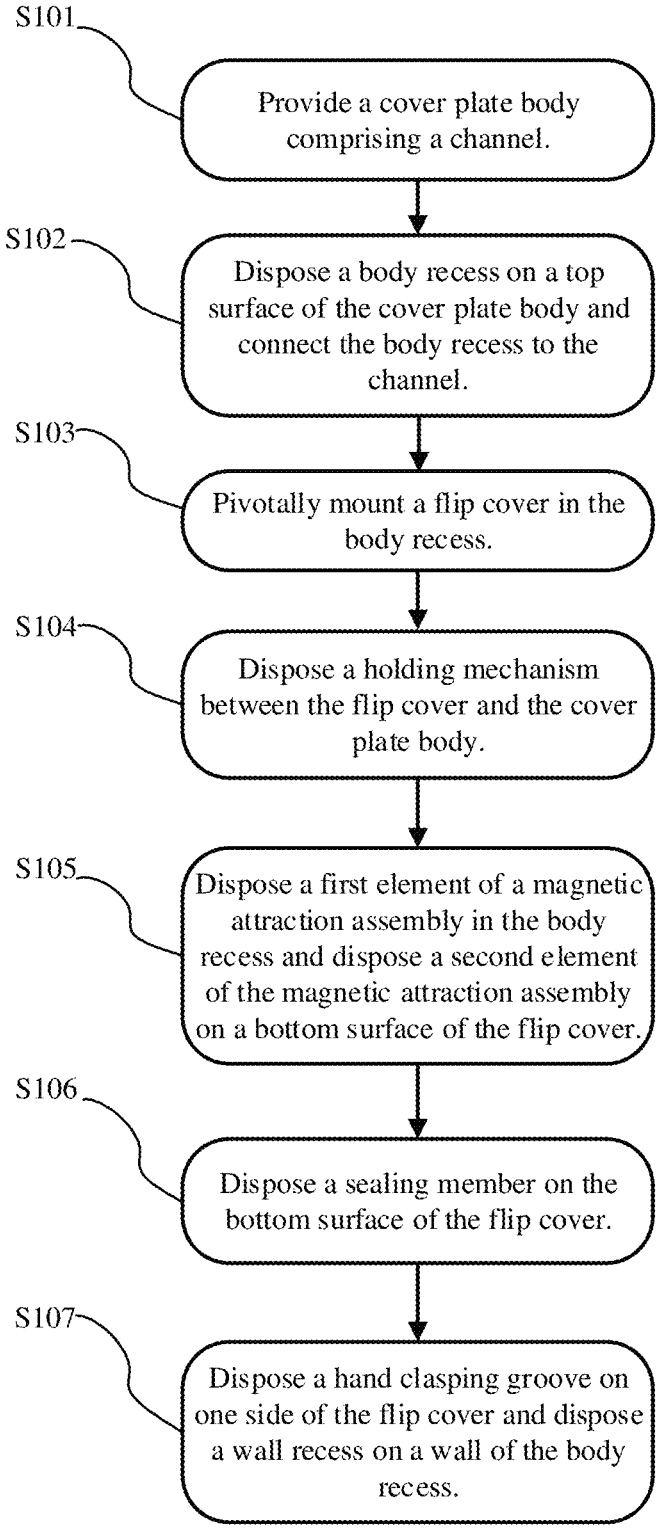
FIG. 7 is a flow chart of a method for assembling a toilet cover plate according to an example of the present disclosure.

FIG. 7 is a flow chart of a method for assembling a toilet cover plate according to an example of the present disclosure. The toilet cover plate to be assembled by the method may be the toilet cover plate according to any of the foregoing embodiments. The toilet cover plate is configured to perform an operation, function, or the like as described in the present disclosure.

At act S101, a user may provide the cover plate body 1 comprising the channel 11. The channel 11 is used for a user to replace the accessories of the toilet.

At act S102, the user may dispose the body recess 12 on the top surface of the cover plate body 1 and connect the body recess 12 to the channel 11.

At act S103, the user may pivotally mount the flip cover 2 in the body recess 12 so as to dispose the flip cover 2 on the cover plate body 1. Specifically, the user may connect the flip cover 2 with the cover plate body 1 through the pivotal shaft 4, and the pivotal shaft 4 is located in the body recess 12.

At act S104, the user may dispose the holding mechanism between the flip cover 2 and the cover plate body 1 to keep the flip cover 2 received in the body recess 12. Specifically, the holding mechanism 3 comprises the elastic member 13, which may be the torsion spring. The user may sleeve the elastic member 13 on the pivotal shaft 4 so as to drive the flip cover 2 to rotate towards the body recess 12 by the elastic force of the elastic member 13. The user may allow the first end of the elastic member 13 to abut against the cover plate body 1 and the second end of the elastic member 13 to abut against the flip cover 2.

At act S105, the user may dispose the first element 321 of the magnetic attraction assembly 32 in the body recess 12 and dispose the second element 322 of the magnetic attraction assembly 32 on the bottom surface of the flip cover 2. One of the first element 321 and the second element 322 are configured to be magnetically attracted to the other of the first element 321 and the second element 322.

At act S106, the user may dispose the sealing member 21 on the bottom surface of the flip cover 2 to seal the opening of the channel 11.

At act S107, the user may dispose the hand clasping groove 22 on one side of the flip cover 2 and dispose the wall recess 13 on the wall of the body recess 12 at the position corresponding to the hand clasping groove 22.

The above technical solutions may be combined as required to achieve the best technical effect.

The above description is merely the principle and the preferred embodiments of the present disclosure. It should be pointed out that, for those of ordinary having ordinary skill in the art, other modifications may be made based on the principle of the present disclosure, which should also be regarded as falling in the protection scope of the present disclosure.

I claim:

1. A toilet cover plate, comprising:

a cover plate body configured to be mounted on a toilet body comprising:

a channel arranged in the cover plate body; and a body recess including a bottom plate, the body recess disposed in a top surface of the cover plate body and connected with the channel, a top portion of the channel located in the bottom plate of the body recess;

a flip cover disposed on the cover plate body and pivotally mounted in the body recess, wherein when the flip cover is in an initial state, the flip cover is received in the body recess and covers an opening of the channel; and a holding mechanism disposed between the flip cover and the cover plate body and configured to keep the flip cover received in the body recess.

2. The toilet cover plate according to claim 1, wherein the holding mechanism comprises an elastic member connected between the flip cover and the cover plate body, and wherein the elastic member is disposed in the body recess and configured to drive the flip cover to rotate towards the body recess by an elastic force of the elastic member.

3. The toilet cover plate according to claim 2, wherein the flip cover is connected with the cover plate body through a pivotal shaft, and the pivotal shaft is located in the body recess, wherein the elastic member is a torsion spring sleeved on the pivotal shaft, and wherein a first end of the torsion spring abuts against the cover plate body and a second end of the torsion spring abuts against the flip cover.

4. The toilet cover plate according to claim 1, wherein the holding mechanism comprises a magnetic attraction assembly configured to attract the flip cover in the body recess, wherein the magnetic attraction assembly comprises:

a first element disposed in the body recess; and a second element disposed on a bottom surface of the flip cover, and wherein one of the first element and the second element are configured to be magnetically attracted to the other of the first element and the second element.

5. The toilet cover plate according to claim 4, wherein one of the first element and the second element is a magnet and the other of the first element and the second element is an iron sheet.

6. The toilet cover plate according to claim 4, wherein a plurality of second elements are disposed on the bottom surface of the flip cover at intervals, and wherein a plurality of first elements are disposed in the body recess at positions corresponding to the plurality of second elements.

7. The toilet cover plate according to claim 1, further comprising a sealing member disposed on a bottom surface of the flip cover and configured to seal the opening of the channel, wherein the sealing member is a sealing gasket or a sealing ring.

8. The toilet cover plate according to claim 7, wherein the sealing gasket or the sealing ring is a foam sealing gasket or a foam sealing ring.

9. The toilet cover plate according to claim 1, further comprising:

a hand clasping groove disposed on one side of the flip cover; and a wall recess disposed on a wall of the body recess at a position corresponding to the hand clasping groove.

10. A toilet, comprising:

a main body comprising a toilet bowl; and a toilet cover plate disposed on the main body and comprising:

a cover plate body, comprising:

a channel arranged in the cover plate body; and a body recess including a bottom plate, the body recess disposed in a top surface of the cover plate body and connected with the channel, a top portion of the channel located in the bottom plate of the body recess;

a flip cover disposed on the cover plate body and pivotally mounted in the body recess, wherein when the flip cover is in an initial state, the flip cover is received in the body recess and covers an opening of the channel; and a holding mechanism disposed between the flip cover and the cover plate body and configured to keep the flip cover received in the body recess.

11. The toilet according to claim 10, wherein the holding mechanism comprises an elastic member connected between the flip cover and the cover plate body, and wherein the elastic member is disposed in the body recess and configured to drive the flip cover to rotate towards the body recess by an elastic force of the elastic member.

12. The toilet according to claim 11, wherein the flip cover is connected with the cover plate body through a pivotal shaft, and the pivotal shaft is located in the body recess, wherein the elastic member is a torsion spring sleeved on the pivotal shaft, and wherein a first end of the torsion spring abuts against the cover plate body and a second end of the torsion spring abuts against the flip cover.

13. The toilet according to claim 10, wherein the holding mechanism comprises a magnetic attraction assembly configured to attract the flip cover in the body recess, wherein the magnetic attraction assembly comprises:

a first element disposed in the body recess; and a second element disposed on a bottom surface of the flip cover, and wherein one of the first element and the second element are configured to be magnetically attracted to the other of the first element and the second element.

14. The toilet according to claim 13, wherein one of the first element and the second element is a magnet and the other of the first element and the second element is an iron sheet.

15. The toilet according to claim 13, wherein a plurality of second elements are disposed on the bottom surface of the flip cover at intervals, and wherein a plurality of first elements are disposed in the body recess at positions corresponding to the plurality of second elements.

16. The toilet according to claim 10, further comprising a sealing member disposed on a bottom surface of the flip cover and configured to seal the opening of the channel, wherein the sealing member is a sealing gasket or a sealing ring.

17. A method for assembling a toilet cover plate, the method comprising:

providing a cover plate body configured to be mounted on a toilet body comprising a channel arranged in the cover plate body;

disposing a body recess including a bottom plate in a top surface of the cover plate body and connecting the body recess to the channel, a top portion of the channel located in the bottom plate of the body recess;

pivotally mounting a flip cover in the body recess so as to dispose the flip cover on the cover plate body; and disposing a holding mechanism between the flip cover and the cover plate body to keep the flip cover received in the body recess.

18. The method according to claim 17, further comprising disposing a first element of a magnetic attraction assembly in the body recess and disposing a second element of the magnetic attraction assembly on a bottom surface of the flip cover.

19. The method according to claim 18, further comprising disposing a sealing member on the bottom surface of the flip cover to seal an opening of the channel.

20. The method according to claim 19, further comprising disposing a hand clasping groove on one side of the flip cover and disposing a wall recess on a wall of the body recess at a position corresponding to the hand clasping groove.

* * * * *